United States Patent [19]

Walker

[11] 4,014,069

[45] Mar. 29, 1977

[54] PIVOTS FOR VENT WINDOW ASSEMBLIES

[75] Inventor: Gary S. Walker, Norristown, Pa.

[73] Assignee: Young Windows Inc., Conshohocken, Pa.

[22] Filed: June 9, 1976

[21] Appl. No.: 694,133

[52] U.S. Cl. ..... 16/140; 49/393

[51] Int. Cl.[2] ..... E05D 11/08

[58] Field of Search ..... 16/128 R, 140, 143, 16/139, 141, 143, 146; 49/390–394

[56] References Cited

UNITED STATES PATENTS

| | | | |
|---|---|---|---|
| 2,698,958 | 1/1955 | Adams | 16/140 |
| 2,743,131 | 4/1956 | Mieras et al. | 16/140 X |
| 2,761,184 | 9/1956 | Renuo | 49/391 |
| 3,990,186 | 11/1976 | Gebhard | 49/393 |

*Primary Examiner*—G. V. Larkin

*Attorney, Agent, or Firm*—Frederick J. Olsson

[57] ABSTRACT

An annular outer frame mounts the assembly in a vehicle. A pair of pivots rotatably support an inner frame (which mounts a window) for rotation about an offset axis between open and closed positions. The pivots can support a frameless window. One of the pivots has a spring-like arm actuated by manually twisting a handle. The arm grips a pivot stud which locks the inner frame or window in a desired position or by proper setting, the gripping pressure exerted by the arm on the stud can provide for a clutch action.

5 Claims, 6 Drawing Figures

PIVOTS FOR VENT WINDOW ASSEMBLIES

This invention relates in general to vent window assemblies having particular utility in the cabs of heavy duty earth moving and construction equipment. More specifically, the invention relates to improved pivots for such window assemblies.

Assemblies of the kind in question have an outer frame adapted to mount the assembly in the vehicle and a window-carrying inner frame (or frameless window) supported on the outer frame by a pair of pivots for rotation between closed and open positions. One of the pivots is an idler pivot and the other is an operating pivot.

The invention herein relates to the operating pivot.

The operating pivot has a handle which, when turned by the operator, will lock the inner frame or window in some desired position or release the same for turning or act as a clutch by restraining the inner frame or window from rotation except in response to an impact.

One of the objects of the invention is to provide an operating pivot mechanism adapted to be located on a top, a bottom or a slant frame member of an assembly and in any such position being readily accessible for actuation by the vehicle operator.

Another object of the invention is to provide an operating pivot mechanism adapted to be locked, unlocked or partially locked simply by the twisting of a handle.

Another object of the invention is to provide an operating pivot mechanism which when locked in the desired position is unaffected by the normal vibrations encountered by the earth moving and construction equipment.

Another object of the invention is to provide an operating pivot mechanism principal parts of which can be formed from extrusions and other parts standard items purchasable on the open market.

Another object of the invention is to provide an operating pivot mechanism which is comprised of simple, rugged components unaffected by normal temperature and humidity changes nor by dust and dirt encountered on construction jobs.

Another object of the invention is to provide an operating pivot mechanism which is comprised of simple, rugged structures adapted to give unfailing performance even when the stresses imposed by the erratic and jarring movements encountered with earth moving and construction equipment.

Other objects and advantages of the invention will be apparent from the following description and drawings wherein.

Figure 1:
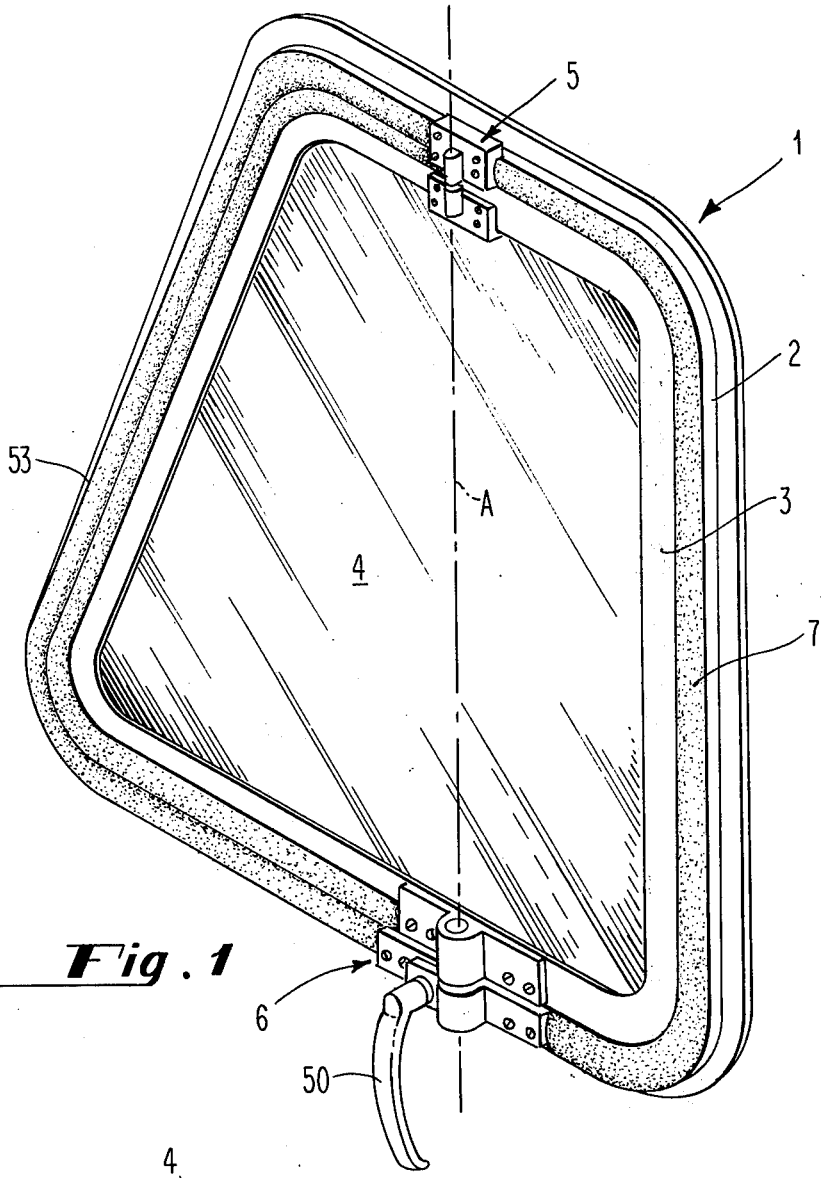
FIG. 1 is a perspective view of a vent window assembly embodying the invention, the assembly being arranged with the window in the closed position.
Figure 2:
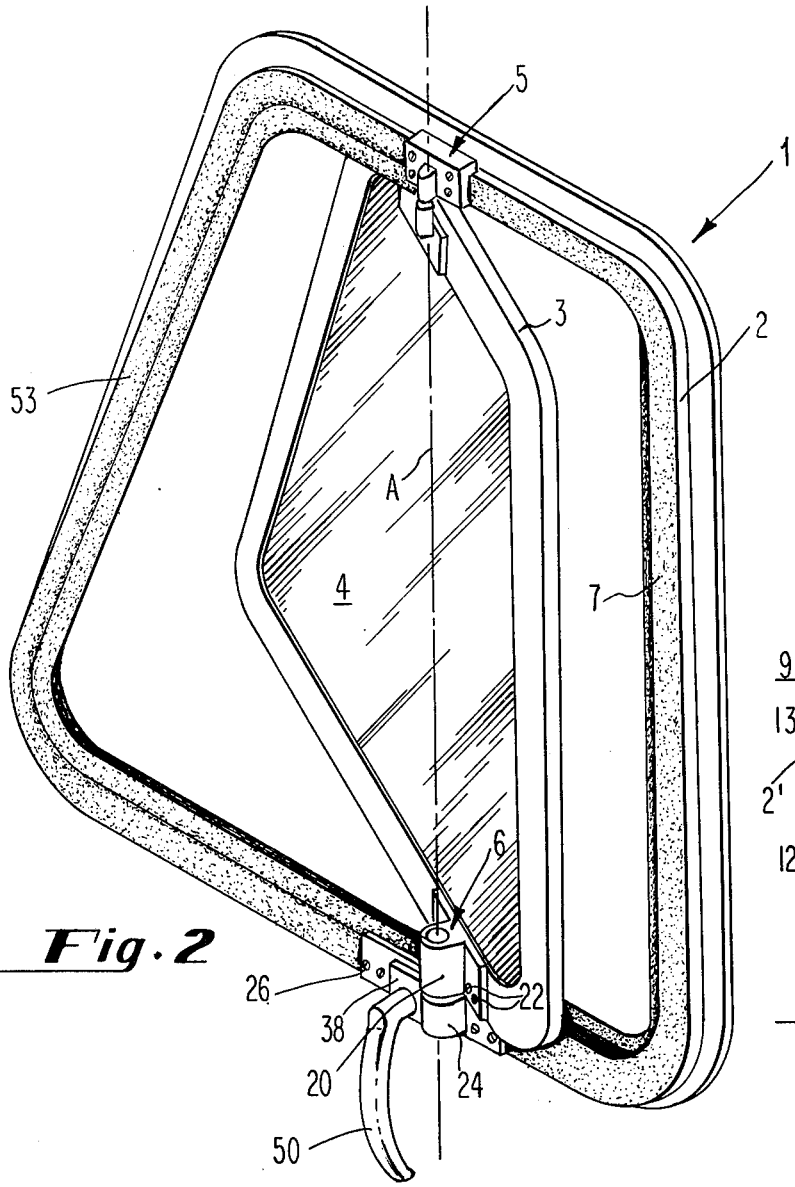
FIG. 2 is a perspective view of the vent window assembly of FIG. 1 with the window in the open position.

Referring to FIGS. 1 and 2 the vent window assembly includes an outer frame 2 and an inner frame 3 which supports the window 4. The inner frame is mounted on the outer frame as by the idler pivot 5 and the operating pivot 6 for rotation between the closed position of FIG. 1 to any open position such as indicated in FIG. 2. The rotation is about the axis A. A seal 7 is mounted around the inner periphery of the outer frame and makes a firm water-tight engagement with the inner frame in the closed position. The inner and outer frames 2 and 3, the idler pivot 5 and seal 7 are similar to the corresponding parts in co-pending application Ser. No. 631,104 filed Nov. 12, 1975, now U.S. Pat. No. 3,990,186, and assigned to the assignee of this application.

Figure 3:
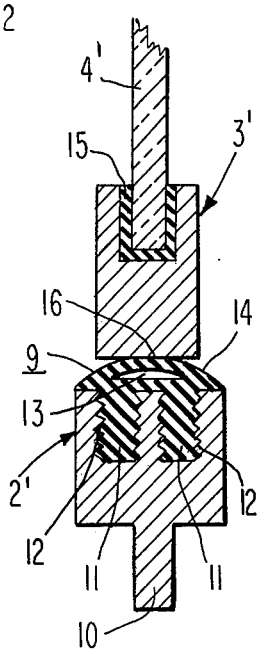
FIG. 3 is a fragmentary sectional view of an alternative form of seal.

An alternative form of seal is illustrated in FIG. 3. The seal 8 extends continuously around the inner periphery of the outer frame 2′ and is connected to the frame by the stems 11 fitting into the serrated slots 12. The seal has an axially extending cavity 13. The outer surface 14 of the seal is contoured as shown. The seal material is conventional synthetic rubber and is formed by cutting pieces of correct length from extruded sections.

The inner frame 3′ is channel shaped in cross section and the gasket 15 locks the window 4′ to the channel.

The surface 14 of the seal is convex with respect to the outer edge 16 of the inner frame. The parts are dimensioned and positioned so that the edge 16 engages the seal and causes the same to slightly yield and thereby making a snug fit. Resiliency of the seal material and the chamber cooperate to produce the proper yield and the sealing forces.

In the embodiments of FIGS. 1, 2 and 3, the inner and outer frames are cut from extruded stock and then bent into the desired contour. The abutting edges of the inner frame are welded while the abutting edges of the outer frame are either welded or joined as shown in co-pending application Ser. No. 358,284 filed May 8, 1973 and assigned to the assignee of this invention.

While in the vent window assembly shown, the glass or window 4 is supported by the inner frame 3, it will be understood that the window may be frameless. This case the pivot 5 and 6 are connected directly to the glass either by a mastic or mechanical fasteners.

In the embodiment shown, the pivot 5 is an idler, that is to say the pivot holds the inner frame for rotation about the axis A and against transverse or radial motion with respect to the axis. The pivot 5 has the same structure as the idler pivot shown in the above mentioned co-pending application Ser. No. 358,281. The pivot stud (not shown) of the pivot 5 is co-axial with the axis A.

The pivot 6 is an operating pivot as it not only serves the pivot function but in addition, is arranged to serve both as a lock and as a clutch. The structure of the pivot 6 will next be described.

Figure 6:
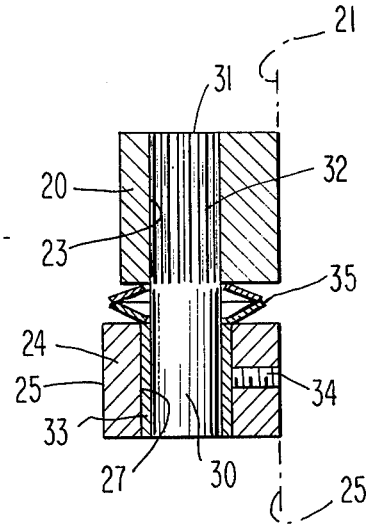
FIG. 6 is a sectional elevational view taken along the line 6—6 of FIG. 4.

An upper housing 20 is connected to the flat, mounting surface 21 of the inner frame as by screws 22. Referring to FIG. 6 the housing 20 has a bore or cavity 23. The axis of the bore is coaxial with the axis A. Directly below the housing 20 is the lower housing 24 connected to the mounting surface 25 of the outer frame as by the screws 26. The housing 25 has a bore 27 which is also co-axial with the rotational axis A. As will be noted hereinafter, bore 27 forms a gripping cavity. A pivot stud 30 whose axis is co-axial with the axis A extends into and between the bores 23 and 27. The end 31 of the stud is driven into the bore 23 so that the splines 32 on the stud penetrate and engage the wall of the bore whereby the stud is fixed in the bore.

The bore 27 carries the split sleeve 33 which surrounds the pivot stud 30. Set screw 34 retains the sleeve against axial movement in the bore 27. A Belleville spring 35 surrounds the stud 30 and is disposed between the housings 20 and 24. The spring transfers thrust (due to the frame 3 and window 4) between the housings 20 and 24 while permitting the housing 20 and the pivot stud to rotate as required.

Figure 5:
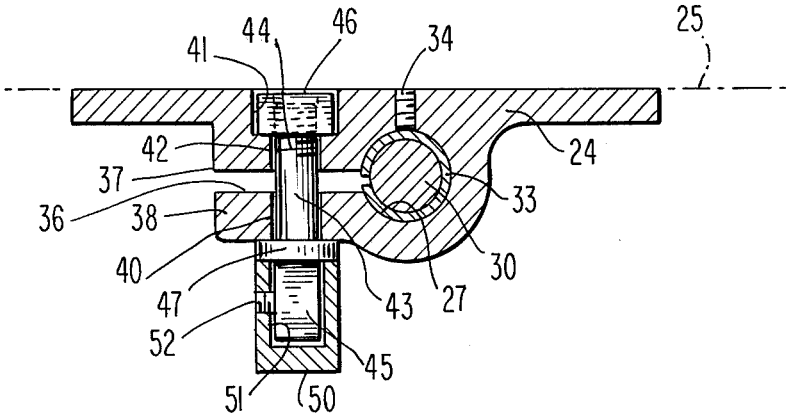
FIG. 5 is a plan section taken along the line 5—5 of FIG. 4.

Referring to FIG. 5, the housing 24 is provided with a gripping slot 36 which extends through the housing in the same direction as the bore or gripping cavity 27. The slot 36 is open to and extends radially from the cavity 27 to the outer periphery of the housing as indicated at 37. This forms the gripping arm 38. The arm partially forms the gripping cavity 27.

The arm 38 has a clearance aperture 40. The housing 24 has a locking slot 41 which extends thru the housing in the same direction as gripping slot. A clearance aperture 42 in the housing is open to the gripping slot 36 and open to the locking slot 41 and is co-axial with the aperture 40.

A gripping stud 43 is disposed in the clearance apertures 40 and 42. The apertures mount the stud for rotation and for axial movement. The end 44 of the stud is threaded while the opposite end 45 is squared, i.e. has four flat contiguous surfaces. The nut 46, captured by the slot 41, is mounted on the threaded end 44. The nut cannot rotate because of its engagement with the walls of the slot 41 and cannot more axially because of its containment by the bottom of the slot and by the mounting surface 25. A shoulder 47 on the stud bears on the gripping arm 38.

A control knob or handle 50 has a square socket 51 which fits over the squared end 45 and is held in position by the set screw 52. The handle can be adjusted to any of the four positions provided by the end 45. The handle rotates the stud 43.

Figure 4:
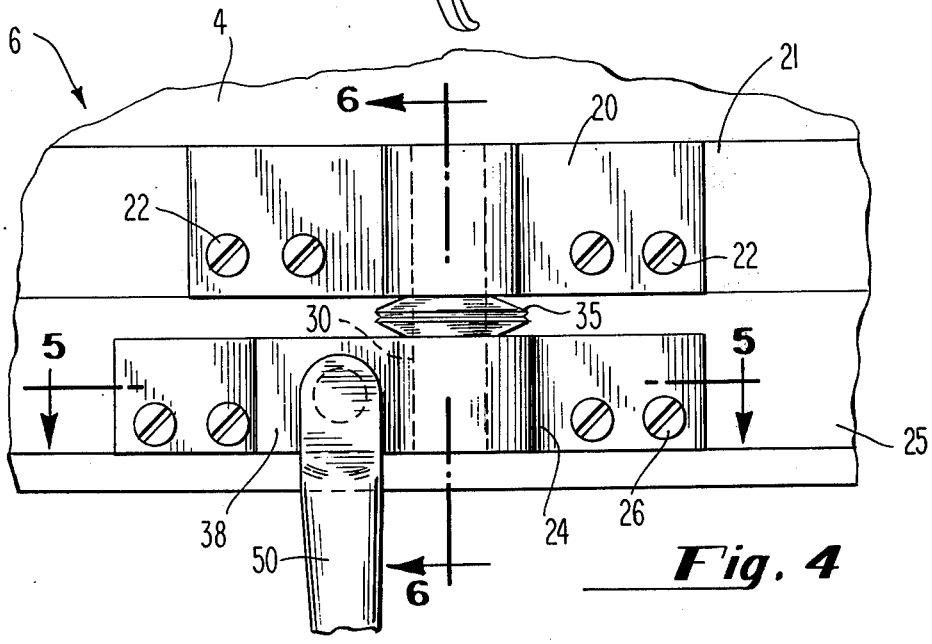
FIG. 4 is an enlarged fragmentary view of the operating pivot mechanism of FIG. 1.

When the handle 50 and stud 43 are rotated clockwise (FIG. 4) the nut 46 will cause the stud 43 to move axially toward the inner frame 3. The shoulder 47 being engaged with the arm 38 will cause the arm to twist clockwise (FIG. 5) and close the cavity 27 and the sleeve 33 so that a gripping force is exerted on the pivot stud 30. With sufficient force, the stud 30 is prevented from rotating and this prevents the inner frame 3 from rotating. If the stud 43 is rotated in the opposite direction, the pressure on the stud 30 is relieved and the inner frame 3 can freely rotate. In FIGS. 1 and 2 the handle 50 is shown in the lock position. To release the window for rotation the handle 50 is moved counter clockwise (usually about a quarter of a turn) until the window can be rotated as desired.

When the vent window is in the open position it is oftentimes expedient to set up the pivot 6 so that an impact on the inner frame will cause the same to rotate and thus avoid breaking of the glass or damage to the assembly. This clutch action condition is brought about by turning the handle 50 somewhat less than the fully locked position. Normally, this can be determined by moving the handle to the fully locked position and then backing off to a point where the operator's hands on opposite sides of the frame can rotate the same by exerting several pounds of force.

The pivot 6 can be employed on the right or left hand of the assembly so that the same can be employed on the left or right hand side of a cab. Also the pivots can be reversed as between the top and bottom. When the pivot 6 is on the top and the pivot 5 is on the bottom the thrust due to the weight of the inner frame is taken by the pivot 5. It is to be noted that in the top position the housing 24 remains connected to the outer frame and the housing 20 remains connected to the inner frame. The housing 20 and 24 are constructed so that the same can be cut from extruded sections. The pivot stud 30, handle 50 and the various screws are standard items.

I claim:

1. Pivot mechanism for vehicle vent window assembly comprising:

a first housing and a second housing, the housings being disposed one above the other;

a pivot stud fixed to the first housing;

a gripping cavity extending thru the second housing and receiving said stud, the axis of the pivot stud and the axis of the gripping cavity being co-axial;

a gripping slot extending thru said second housing in the same direction as said gripping cavity and also extending from the periphery of the second housing to said gripping cavity and the slot forming a moveable, resilient gripping arm on the second housing;

a clearance aperture formed in said gripping arm;

a locking slot extending thru said second housing in the same direction as said gripping slot;

a clearance aperture formed in the second housing in alignment with first said clearance aperture and extending between and open to said gripping slot and to said locking slot;

a gripping stud disposed in said clearance apertures and having a threaded end extending into said locking slot, the clearance apertures mounting the stud for rotation and for axial movement;

a shoulder on said gripping stud inwardly of said square end and bearing on said gripping arm;

a nut on the threaded end of the gripping stud and engaging the walls of the locking slot whereby rotation of the nut is restrained;

a control knob mounted on the gripping stud;

rotation of the knob in one direction causing the gripping stud to rotate in said nut and thereby move axially so that said shoulder exerts pressure on the gripping arm and moves the arm in a direction to collapse said gripping cavity and thereby exert a gripping force on the pivot stud and movement of the control knob in the opposite direction causing the gripping stud to rotate in said nut and thereby move axially in the opposite direction so that said shoulder relieves pressure on the gripping arm whereby the resiliency of the arm moves the same in the opposite direction to expand the cavity to relieve the gripping force on the pivot stud.

2. The vent window assembly of claim 1 wherein said pivot stud is fixed to said first housing by splines on the stud engaging the first housing and further including a split bushing in said gripping cavity and partially surrounding said pivot stud.

3. The vent window of claim 1 wherein the opposite end of said gripping stud has a square end and said control knob is an elongated handle-like member extending radially outwardly of its rotational axis, one end of the knob being formed with a square cavity, the cavity removeable mounting the knob on said square end and providing for the knob to be selectively positionable in a direction around the axis of said gripping stud.

4. Pivot mechanism for a vehicle vent window assembly comprising;

a first housing and a second housing, the housings being disposed one above the other;

a stud fixedly connected to said first housing;

a gripping cavity in said second housing and receiving said stud;

a gripping arm on the second housing and at least partially forming said gripping cavity;

mechanism connected with said control knob and with said gripping arm to cause the gripping arm to move to collapse said cavity whereby a gripping force is exerted on the stud and also to move to expand the cavity to relieve said gripping force;

a rotary control knob;

means connected between said control knob and said second housing for moving said arm; and rotation of the control knob in one direction causing the gripping arm to relieve said gripping force and rotation in the opposite direction causing the gripping means to exert said gripping force.

5. The vent window of claim 4 wherein the control knob is an elongated handle-like member extending radially outwardly of its rotational axis.

* * * * *